United States Patent [19]

Faucher et al.

[11] 4,179,881

[45] Dec. 25, 1979

[54] PREMIX COMBUSTOR ASSEMBLY

[75] Inventors: Joseph E. Faucher, East Hartford; Robert W. Koucky, West Hartford; William D. Roy, Glastonbury, all of Conn.

[73] Assignee: United Technologies Corporation, Hartford, Conn.

[21] Appl. No.: 515,789

[22] Filed: Oct. 17, 1974

Related U.S. Application Data

[63] Continuation-in-part of Ser. No. 336,578, Feb. 28, 1973, abandoned.

[51] Int. Cl.[2] ..... F02C 7/22

[52] U.S. Cl. ..... 60/39.71; 60/39.72 R

[58] Field of Search ..... 60/39.65, 39.74, 39.71, 60/39.72 R

[56] References Cited

U.S. PATENT DOCUMENTS

| | | | |
|---|---|---|---|
| 2,601,000 | 6/1952 | Nerad | 60/39.65 |
| 2,635,426 | 4/1953 | Meschino | 60/39.65 |
| 3,055,179 | 9/1962 | Lefebvre et al. | 60/39.65 |
| 3,820,324 | 6/1974 | Grindley et al. | 60/39.65 |

*Primary Examiner*—Stephen C. Bentley

*Attorney, Agent, or Firm*—Norman Friedland

[57] ABSTRACT

A combustor assembly having improved performance and improved pollution emission characteristics includes an annular combustion chamber and a premixing passageway having an outlet positioned adjacent either the inner or outer annular wall of the combustion chamber. The outlet is in gas communication with the combustion zone and has a perforated baffle thereacross. Air from the compressor enters the premixing passageway and atomizes fuel injected therein. The fuel-air mixture is directed from the premixing passageway through the perforated baffle radially across the combustion zone toward the opposite wall of the combustion chamber. The perforated baffle creates a localized stagnation region adjacent its surface which acts as a continuous ignition source for the combusting fuel-air mixture within the primary combustion zone. Additional air from the compressor is flowed to the combustion zone through openings in the inner and outer wall.

15 Claims, 3 Drawing Figures

PREMIX COMBUSTOR ASSEMBLY

The invention described herein was made under or during the course of a contract with the Department of the Air Force.

CROSS REFERENCE TO RELATED APPLICATIONS

This application is a continuation in part of Application Ser. No. 336,578 which was filed on Feb. 28, 1973, now abandoned and assigned to United Aircraft Corporation.

BACKGROUND OF THE INVENTION

1. Field of the Invention

This invention relates to combustion chambers for gas turbine engines.

2. Description of the Prior Art

The emphasis today on the design and development of gas turbine engines for jet aircraft is towards pollution control and reduction in engine weight without thrust penalties. Much of this design and development work is centered on the combustor section of the engine which, conventionally, has not provided the clean burning which is now desired. Furthermore, conventional combustors require a considerable axial length to perform the burning process; this increases the overall engine length, which of course results in an increase in engine weight.

Premixing of the fuel with the air is one technique which has been investigated to improve the combustion process. U.S. Pat. No. 2,999,359 to F. R. Murray shows such a technique in FIG. 2. One purpose of all the constructions shown in Murray is to create recirculating counter-rotating zones of combusting fuel and air within the primary combustion zone to improve combustion efficiency. Such recirculation increases the length of time the combusting fuel and air remains in the primary zone of combustion; this is undesirable from a pollution viewpoint since it increases the amounts of oxides of nitrogen produced within the combustion chamber.

Another type of premix combustion chamber is shown in U.S. Pat. No. 2,679,137 to Probert. A mixture of fuel and air is admitted to a primary or pilot combustion zone through a baffle at the forward end of the combustion chamber. Only a portion of the fuel is burned in the primary combustion zone with the remainder of the fuel being burned in a downstream combustion zone upon the entry of additional dilution and combustion air. The reburning of combusting fuel in the downstream zone increases, as in Murray, the length of time that the gases are exposed to combustion temperatures and correspondingly increases the amounts of oxides of nitrogen produced within the combustion chamber. Continuing efforts are being directed to the design of combustion chambers which are capable of fully combusting fuel with a limited axial length while minimizing the recirculation of combusting gas through high temperature zones.

SUMMARY OF THE INVENTION

A primary object of the present invention is to provide a combustor assembly for gas turbine engines having improved performance and pollution characteristics.

The present invention is predicated upon the recognition that oxides of nitrogen are produced within a combustion chamber in proportion to the effective axial length of the combustion process. Furthermore, the reduction of unburned hydrocarbon emissions is aided by the thorough mixing of fuel and air prior to the combustion process.

In accordance with the present invention a mixture of fuel and air from a premixing passageway is directed across a baffle disposed between the inner and outer walls of a combustion chamber, the baffle having openings therein for directing the fuel-air mixture in a predominantly radial direction across the combustion zone toward the opposite wall of the chamber; combustion and dilution air is flowed to the combustion zone through circumferentially spaced openings in the inner and outer walls of the combustion chamber, the openings being located immediately downstream of the baffle to enable completion of the combustion process within the vicinity of the baffle.

Improved combustion stability at low power is provided by the present construction. As the power level of the engine is decreased the amount of fuel injected into the premixing passage decreases in relation to the mass of the flowing air. In the present construction only a portion of the combustion air flows through the baffle so that the fuel air ratio in the vicinity of the baffle remains relatively high.

Mixing the air and fuel within the passageway prior to injecting it into the combustion chamber avoids many of the problems associated with conventional combustion chambers which spray the fuel directly into the combustion chamber and require means and methods, including additional effective combustion chamber length, to thoroughly mix the fuel and air within the combustion chamber during the burning process. The construction of the present invention causes a uniform fuel-air mixture to burn within the chamber without requiring large recirculation regions in the combustion zone to assure a proper mixture of fuel and air for efficient burning.

In the present invention, as the fuel-air mixture enters the combustion chamber through the openings in the baffle, small eddies of the fuel-air mixture are created in the immediate vicinity of the baffle between adjacent openings; these eddies create stagnation regions adjacent the baffle. These stagnation regions act as a continuous ignition zone for keeping the fuel-air mixture within the primary combustion zone ignited. Preferably, the baffle is frusto-conical in shape, is located adjacent the inner wall of the combustion chamber, and slopes inwardly from an upstream to downstream direction, whereupon the fuel-air mixture is directed in a radially outward direction across the primary combustion zone toward the outer wall of the annular combustion chamber. The pressure drop across such a baffle is from the inside of the cone to the outside of the cone putting the frusto-conical shape in hoop stress, which is desirable. Additional combustion air is admitted to the chamber through openings immediately adjacent the baffle.

The foregoing and other objects, features and advantages of the present invention will become more apparent in the light of the following detailed description of the preferred embodiment thereof as illustrated in the accompanying drawing.

DESCRIPTION OF THE PREFERRED EMBODIMENT

Figure 1:
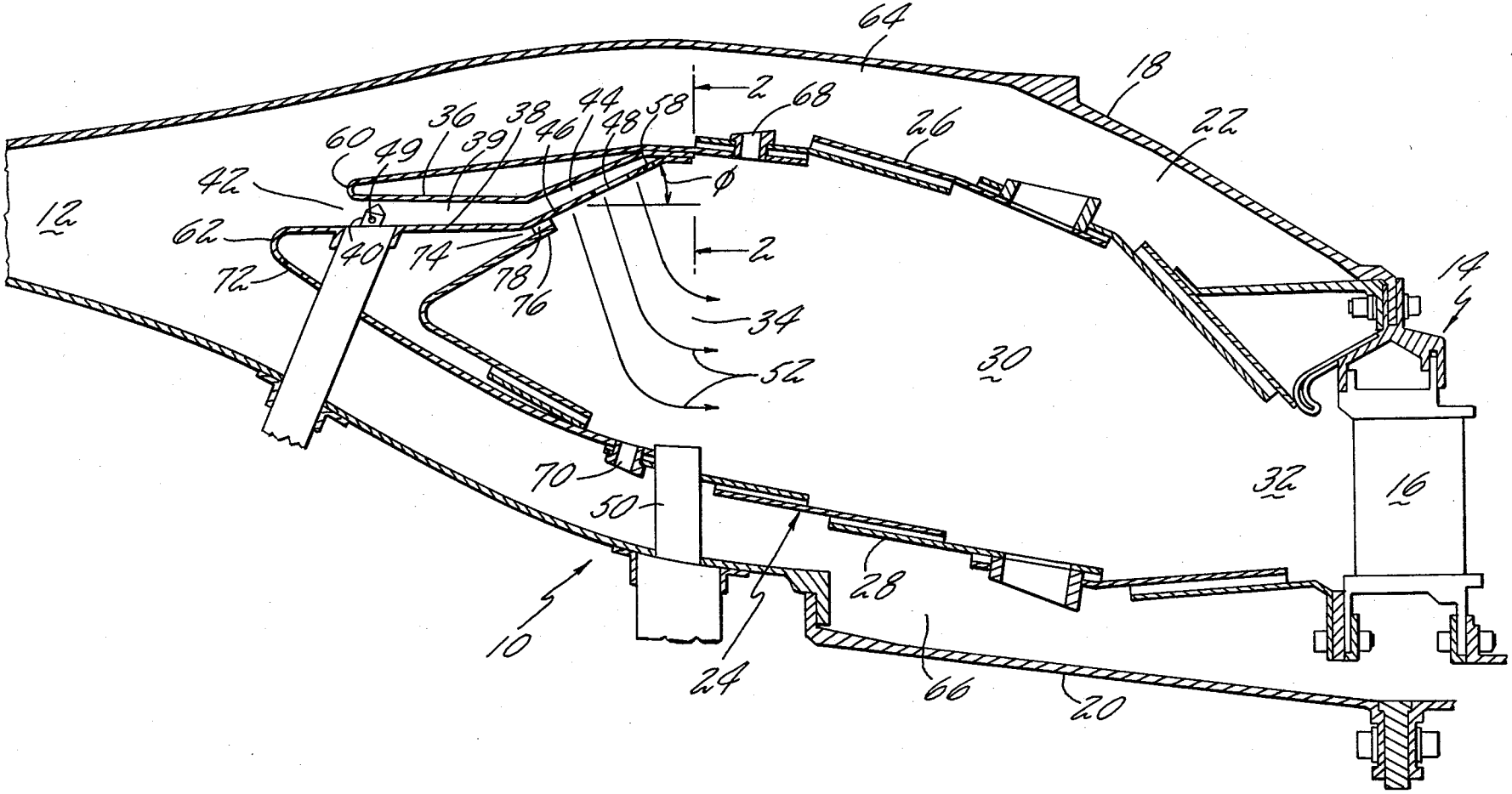
FIG. 1 is an elevation cross sectional view of the combustor section of a gas turbine engine incorporating the present invention.

As an example of a combustor assembly incorporating the features of the present invention, consider the combustor assembly of FIG. 1 generally represented by the numberal 10. The combustor assembly 10 is situated downstream of a diffuser section 12 (only a portion of which is shown) and upstream of a turbine section 14; only the inlet guide vane 16 of the turbine section 14 is shown.

The combustion assembly 10 includes an inner annular casing 18 and an outer annular casing 20 forming an annular space 22 therebetween. Disposed within the annular space 22 is an annular combustion chamber generally represented by the numeral 24. The combustion chamber 24 includes an inner annular wall 26 and an outer annular wall 28 defining an annulus 30 therebetween. The walls 26, 28 also form an annular outlet 32 at the downstream end of the combustion chamber 24 for directing combustion products into the turbine section 14. The upstream portion 34 of the annulus 30 is the primary combustion zone. Mounted on the outer annular casing 20 and extending into the primary combustion zone 34 are a plurality of circumferentially spaced ignition means 50 which are shown herein to be conventional spark igniters. The ignition means 50 is mounted in the outer annular casing 20 for ease of removal, but for the purposes of the present invention they could be positioned adjacent the inner annular wall 26 if desired.

According to the present invention, inner annular duct means 36 and outer annular duct means 38 are disposed within the annular space 22 and are spaced apart from each other forming an annular premixing passage 39. In this embodiment the duct means 36, 38 are made of sheet metal and are attached at their downstream ends to the inner annular wall 26 of the combustion chamber 24.

The premixing passage 39 includes an annular inlet 42 and an annular outlet 44. The outlet 44 being in gas communication with the primary zone 34 of the combustion chamber 24. In this embodiment the inner annular wall 26 includes a baffle 46. The baffle 46 is disposed across the outlet 44 of the premixing passage 39. Also, in this embodiment the baffle 46 is frusto-conical in shape and tapers radially inwardly from an upstream to downstream direction, its upstream and downstream ends being attached by suitable means to the inner annular wall 26 of the combustion chamber 24. The baffle 46 has a plurality of openings 48 therethrough, best shown in FIG. 2. Mounted on the outer annular casing 20 and extending into the premixing passage 39 are a plurality of circumferentially spaced fuel injectors 40, for supplying fuel to the premixing passage 39.

In operation, air from the compressor (not shown) enters the diffuser 12 and from there is received at a high velocity into the premixing passage 39; the size of the premixing passage 39 and the area of the openings 48 through the baffle 46 contribute to controlling the velocity of the air through the passage 39. In this embodiment the velocity of the air in the passage is about 350 feet/second. The injectors 40 inject fuel into the passage 39, whereupon it is atomized by the high velocity air. In this embodiment forty circumferentially spaced fuel injectors 40 are positioned within the passage 39 to achieve a circumferentially uniform fuel-air mixture at the outlet 44 of the passage 39. One of the advantages of this invention is that low pressure drop fuel injectors may be used since atomization of the fuel is accomplished by the high velocity air rushing past the injectors 40 and not by the action of the fuel injector itself. In other words, the fuel may be injected into the passage 39 through relatively large holes in the fuel injectors. In this preferred embodiment fuel is squirted from the fuel injectors 40 in a tangential direction (i.e. into or out of the plane of the paper in FIG. 1) through 0.060 inch diameter holes 49, one each on the left and right sides as viewed from an upstream or downstream direction of each fuel injector 40.

The fuel-air mixture leaves the passage 39 through the openings 48 (best shown in FIG. 2) in the baffle 46; the shape of the baffle 46 and the orientation of the openings 48 direct the fuel-air mixture radially outwardly across the primary combustion zone 34 toward the outer annular wall 28. The velocity of the flow through the openings 48 is sufficient to propel at least a portion of the fuel-air mixture across the primary combustion zone to the outer annular wall 28. The fuel-air mixture within the primary combustion zone travels immediately downstream rather than recirculate within major flame stabilization regions as in conventional burners. The arrows 52 represent the fuel-air mixture and its path of travel as it leaves the premixing passage 39. Whether the fuel air mixture recirculates in the conventional manner or whether it travels in the manner of the present invention as indicated by the arrows 52 depends in substantial part on the pressure field within the combustion chamber. In the present invention the openings 48 in the baffle 46 and the holes in the combustion chamber walls 26, 28 are positioned and sized to create a pressure field which compels the fuel-air mixture to travel in the direction of the arrows 52 rather than to predominantly recirculate. It would be obvious to anyone with ordinary skill in the art as to how to establish such a pressure field if one had the predilection to do so.

It is important that the baffle 46 and the openings 48 therethrough direct the fuel-air mixture radially across the primary combustion zone; thus, they must be designed to impart a velocity to the fuel-air mixture having a substantial radial component. The cone angle $\theta$ of the frustoconical baffle in the embodiment shown in FIG. 1 is approximately 25 degrees. An important consideration to keep in mind when choosing a cone angle is that if the cone angle is too large the fuel-air mixture might be injected in a substantially axial direction adjacent the inner annular wall 26 of the combustion chamber. There are two basic reasons why this is undesirable. First, it may be difficult to ignite the fuel-air mixture since the igniters 50 are positioned along the outer annular wall 28; second, most of the burning would occur adjacent the inner wall 26 resulting in an uneven temperature distribution across the turbine inlet guide vanes 16.

Figure 2:
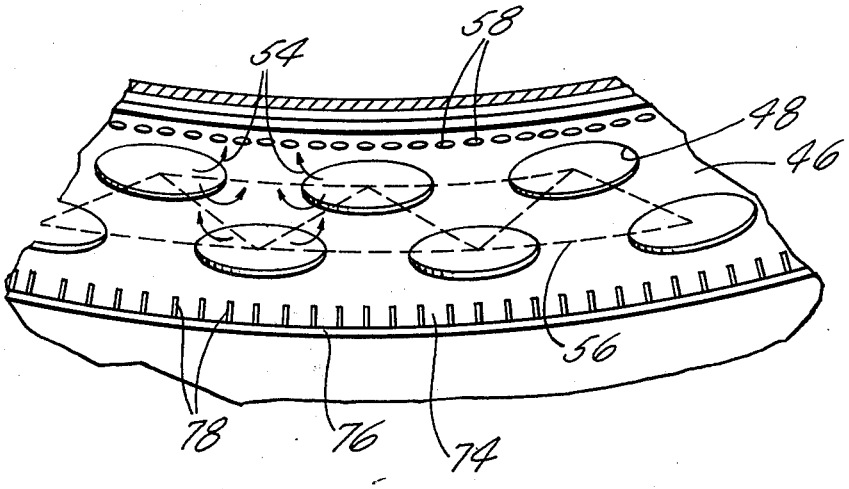
FIG. 2 is a partial cross sectional view taken along the line 2—2 of FIG. 1.

Referring to FIG. 2, as the fuel-air mixture passes through the openings 48 small local eddies are created in the immediate vicinity of the openings and adjacent the surface of the baffle 46 as generally represented by the arrows 54; in this embodiment the openings 48 are circular and are disposed in two axially spaced rows, each row having a similar number of holes except that the openings 48 in one row are staggered with respect to the openings 48 in the other row such that a triangular pattern represented by the dashed lines 56 is formed. As a result of the eddies 54, a stagnation region is created adjacent each triangular portion of the baffle 46. This region of stagnant combusting air-fuel mixture provides a continuous ignition source for the fuel-air mixture within the primary combustion zone 34. Once this region of fuel-air mixture is ignited by the spark igniters 50, it is able to remain lit due to the very low velocities of the fuel and air within the region.

Figure 3:
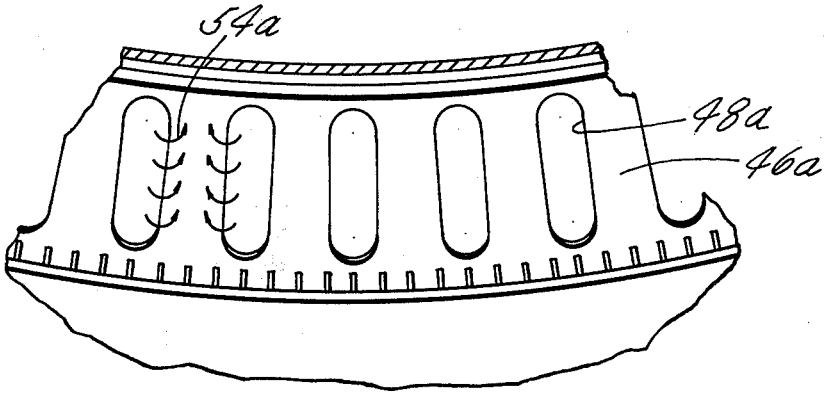
FIG. 3 is a partial cross sectional view also taken along the line 2—2 of FIG. 1, but showing an alternate construction.

FIG. 3 shows an alternate construction of the baffle 46. In this construction the baffle is designated by the numeral 46*a*. Rather than circular openings 48, the baffle 46*a* is provided with a plurality of axially extending and circumferentially spaced slots 48*a*. As the fuel-air mixture passes through the slots 48*a* local eddies are created in the immediate vicinity of the slots and adjacent the surface of the baffle 46*a* as generally represented by the arrows 54*a*. As a result of the eddies 54*a*, a stagnation region is created adjacent the surface of the baffle 46*a* between adjacent slots. This stagnation region acts in a manner similar to the stagnation regions in the embodiment of FIG. 2. Although the pattern and the shape of the openings through the baffle are shown herein as being either slots or circular holes, the precise shape and placement of these openings is not critical to the present invention. The most important consideration is the ratio of the open area of the baffle to the closed area of the baffle. The ideal percent of open area through the baffle varies with engine design and would depend mainly on the pressure drop across the baffle, the desired velocity of the air in the premix passage, and the temperature rise desired from the exit of the compressor to the inlet of the turbine. For most engine applications the open area would be within the range of 30 to 50 percent of the total area of the baffle.

As hereinbefore stated, the fact that the fuel-air mixture does not, to any significant extent, recirculate within the primary combustion zone reduces the time that the combusting fuel-air mixture remains within this very hot zone. It is known that the very high temperatures within the primary combustion zone contribute to the formation of oxides of nitrogen; and the longer the combusting fuel-air mixture remains within this very hot zone the more oxides of nitrogen produced. The length of the very hot zone in the preferred embodiment of the present invention is limited to the vicinity of the baffle by the introduction of combustion and dilution air from an inner annulus 64 through circumferentially spaced openings 68 in the inner annular wall 26 and from an outer annulus 66 through circumferentially spaced openings 70 in the outer annular wall 28. Although the air flowing through the spaced opening of the inner and outer walls travels in an initially radial direction, it is deflected axially downstream by the combustable gases flowing from the baffle 46 thereby preventing major upstream recirculation of gases within the combustion chamber. Thus, one very important feature of this invention is a reduction in the amount of oxides of nitrogen in the exhaust gases of a gas turbine engine.

There are several considerations in the design of the premix passage 39. The axial length of the passage from the point where the fuel is injected to the point furthest downstream where the fuel leaves the passage through the openings 48 in the baffle 46 must be short enough such that auto-ignition does not occur before the mixture enters the combustion chamber; if there is enough dwell time of the fuel within the passage, and if the temperature and pressure of the fuel-air mixture is high enough, the mixture could ignite spontaneously prior to leaving the passage. In this preferred embodiment, bleed holes 58 (best shown in FIG. 2) at the downstream end of the baffle 46 assure that fuel is not able to accumulate in the downstream end of the premix passage such that auto-ignition would be more likely to occur. Additionally, the total area of the openings 48 through the baffle 46 should be larger than the area of the inlet 42 to the passage so that the fuel-air mixture can exit into the combustion chamber 24 at least as fast as the air entering the premix passage to prevent flashback. Also, the shape of the passage should be such that eddies are not created within the passageway; eddies might entrain the fuel-air mixture within the passage giving it time to ignite prior to entering the combustion chamber 24; for this reason the passage 39 should have no sharp edges and no sharp turns to cause separation of the flow at the walls of the passage.

In the embodiment shown in FIG. 1 the inner annular wall 26 is outwardly spaced from the inner annular casing 18 forming an inner air annulus 64 therebetween, and the outer annular wall 28 is inwardly spaced from the outer annular casing 20 forming an outer air annulus 66 therebetween. The duct means 36, 38 form flow divider means 60, 62 respectively, the flow divider means 60 directing a portion of the air from the compressor into the inner air annulus 64, and the flow divider means 62 directing a portion of the air from the compressor into the outer air annulus 66. The premix passage 39 and the baffle 46 are designed so as to receive sufficient air into the passage to maintain the proper equivalence ratio of the fuel-air mixture entering the primary combustion zone 34 for appropriate emission control. Additional quantities of air from the inner and outer air annuli 64, 66 are directed into the primary combustion zone 34 through a plurality of circumferentially spaced openings 68, 70 through the inner and outer annular walls 26, 28, respectively. Remaining air within the inner and outer air annuli 64, 66 is used for cooling the walls 26, 28, for secondary air downstream of the primary combustion zone, for dilution air downstream of the combustion zone, and for cooling the inlet guide vanes 16 of the turbine section 14.

Further in this embodiment, a small amount of the air entering the outer air annulus 66 is directed through a plurality of holes 72 through the divider means 62; this air is directed over the face of the baffle 46 through an annular opening 74 formed between the downstream end of the outer annular duct 38 and the downstream end of an upstream annular segment 76 of the outer annular wall 26. As best shown in FIG. 2, a plurality of small spacers 78 maintain the annular space 74 through which the cooling air passes.

Although the premix passage 39 in this embodiment is shown being adjacent the inner annular wall 26, it is also contemplated that a combustor assembly may be designed having the premix passage adjacent the outer annular wall of the combustion chamber. In that case the shape of the baffle and the openings through the baffle would be designed to direct the fuel-air mixture radially inwardly across the primary combustion zone toward the inner annular wall of the combustion chamber. In that instance the baffle would slope radially outwardly from an upstream to downstream direction. In either case, the pressure within the premix passage 39 is higher than the pressure within the primary combustion zone 34; thus a frusto-conical baffle positioned adjacent the inner annular wall 26, as shown in FIG. 1, would be put in hoop stress, while a baffle positioned adjacent the outer annular wall 28 would be put in compression. Since a frusto-conical shape is better able to withstand a hoop stress rather than a buckling load, it is preferable that the baffle and thus the premix passage be positioned adjacent the inner annular wall.

It has been determined in tests of combustor assemblies constructed according to the present invention that the volume of the combustion chamber required for complete burning of the fuel is 50 percent less than the volume required in combustion systems using conventional fuel supplying devices. This is due to the better mixing of the fuel and air within the combustion zone and the more even distribution of the fuel and air over the entire radius of the combustor volume. It has also been determined that there is a 50 percent reduction in the amount of oxides of nitrogen in the exhaust gases as compared to conventional burners; furthermore, this type of burner has low smoke emissions and has shown a significant reduction in unburned hydrocarbons.

A burner constructed in accordance with the present invention has improved flame stability over conventional premix combustion chambers where the entire amount of combustion air is mixed with the fuel before it is flowed into the chamber. At low power the flame stability is a function of the fuel/air ratio in the vicinity of the flameholding baffle. When the fuel air ratio becomes low insufficient energy is produced at the combination site to maintain the fuel ignition temperature within the region and the flame becomes extinguished. In the present construction only a portion of the combustion air is premixed to allow a higher fuel air ratio at the baffle during low power operation. The remaining combustion air is flowed into the chamber immediately downstream of the baffle to complete the combustion process while the fuel is still within the area adjacent the baffle.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. A combustor assembly for an axial flow gas turbine engine including a compressor forward of said assembly and a turbine rearward of said assembly, said combustor assembly comprising:

casing means forming an annular space about the engine axis;

wall means disposed within said annular space forming an annular combustion chamber, said chamber including inner and outer walls defining a combustion zone at the upstream end of said chamber, said wall means forming an outlet at the downstream end of said chamber for directing combustion products into the turbine;

duct means within said annular space forming a premixing passage having an inlet and an outlet, said premixing passage being wholly forward of said passage outlet, said inlet adapted to receive, into said premixing passage, air being discharged from the compressor; and fuel supply means disposed within said premixing passage for introducing fuel into said premixing passage, the flow of air within said premixing passage atomizing the fuel within the premixing passage, said premixing passage outlet being adjacent one of said walls of said chamber and being spaced from the other of said walls and being in gas communication with said combustion zone, said wall means including baffle means disposed across said outlet of said premixing passage, for directing the fuel-air mixture from said premixing passage radially across said combustion zone toward said other wall of said chamber, said baffle means having a plurality of openings therethrough which in combination comprise thirty to fifty percent of the baffle area, said wall means including means to impart a downstream velocity to said fuel-air mixture immediately upon its being directed radially toward said other wall, said baffle means including a downstream facing surface creating stabilization regions within said combustion zone immediately adjacent said downstream facing surface of said baffle means between adjacent openings, wherein said stabilization regions are a continuous ignition source for said combustion zone during operation.

2. The combustor assembly according to claim 1 wherein said passage outlet is adjacent said inner wall of said chamber and said openings through said baffle means are for directing the fuel-air mixture from said passage radially outwardly across said combustion zone toward said outer wall of said chamber.

3. The combustor assembly according to claim 2 wherein said premixing passage and said passage outlet is annular about the engine axis, and said baffle means is generally frusto-conical in shape, sloping radially inwardly from an upstream to downstream direction, the downstream end of said baffle means being adjacent said inner wall of said chamber, and wherein said fuel supply means includes a plurality of fuel injectors circumferentially spaced within said premixing passage.

4. The combustor assembly according to claim 3 wherein said casing means includes means outwardly spaced from said outer wall forming an outer air annulus therebetween and means inwardly spaced from said inner wall forming an inner air annulus therebetween, and wherein said duct means includes flow divider means for directing a portion of the air exiting from the compressor into said inner air annulus and for directing a portion of the air exiting from the compressor into said outer air annulus, said inner and outer walls having openings therethrough adjacent the combustion zone for introducing additional air into the combustion zone.

5. An annular combustor having improved emissions for a turbine type power plant having an inner casing and outer casing defining an annular chamber, liner means closed at one end and opened at the other directly communicating with the turbine of the power plant disposed in said annular chamber defining a combustion chamber, an annular premix passage formed adjacent the closed end of said liner by said liner and a circular wall surrounding said liner having an annular inlet receiving compressor air, a baffle at the downstream end of said premix passage having openings whose axis is at an angle relative to the axis of the combustion chamber interconnecting said passage with said combustion chamber so as to discharge a fuel/air mixture radially into the combustion chamber and the openings creating localized eddies adjacent the downstream side of said baffle between said openings, circumferentially spaced apertures located axially downstream of said baffle formed in said liner for admitting into said combustion chamber a portion of air from said compressor, said apertures being dimensioned with respect to the openings in said baffle to create a pressure field in said combustion zone to direct the products of combustion in substantially an axial direction without incurring large recirculation zones, and a fuel nozzle disposed in said premix passage axially spaced from said baffle a sufficient distance to achieve atomization of the injected fuel in the absence of auto-ignition.

6. An improved annular combustor as claimed in claim 5 wherein said baffle is frusto-conically shaped with its base located at the most downstream end of said premix passage and having a plurality of openings of which constitute 30–50% of the entire baffle area and the total area of said openings being greater than the area of the inlet of said premix passage.

7. Means for reducing the pollutants emitted from an axial flow gas turbine engine, which engine includes a combustor, a compressor forward of said combustor and a turbine rearward of said combustor, said means comprising:

means disposed in said combustor for burning fuel including a first wall means defining an annular combustion chamber around the axis of said engine having a combustion zone at the upstream end thereof, said first wall means forming an outlet at the downstream end of said chamber for directing combustion products into the turbine;

second wall means surrounding a portion of the first wall means and radially spaced therefrom forming an annular premixing passage having an inlet and an outlet, and said premixing passage being wholly forward of said passage outlet for receiving air being discharged from the compressor;

fuel supply means disposed within said premixing passage for introducing fuel into said premixing passage, the flow of air within said premixing passage atomizing the fuel within the premixing passage, said premixing passage being in gas communication with said combustion zone, baffle means having apertures formed therein disposed across said outlet of said premixing passage for directing the fuel-air mixture from said premixing passage radially across said primary combustion zone toward said other wall of said chamber, said baffle means including a downstream facing surface creating localized eddies within said combustion zone immediately adjacent said downstream facing surface of said baffle means between adjacent openings, and said localized eddies defining stabilization regions for continuous ignition for said combustion zone.

8. Means as defined in claim 7 including an outer casing surrounding and spaced from said first wall means defining therewith an annular passage having an inlet receiving air flow from said compressor, circumferentially spaced holes axially spaced in said first wall means for admitting combustion air and dilution air into said combustion chamber, said circumferentially spaced holes having a predetermined area ratio to the area of said apertures for creating a predetermined pressure field whereby said fuel-air mixture flows substantially in an axial direction from upstream to downstream in said combustion chamber so as to avoid relatively large recirculation zones.

9. Means as defined in claim 8 wherein said apertures are spaced ahead of said combustor air and dilution air holes with respect to said turbine.

10. Means as defined in claim 8 wherein said wall means includes an inner and outer wall, said inner wall being closer to said engine axis, said baffle means being disposed adjacent to said inner wall and forming apart thereof to define a substantially front facing portion of said combustion chamber.

11. Means as defined in claim 10 wherein said baffle means is generally frusto-conical in shape, sloping radially inwardly from an upstream to downstream direction with respect to the flow of said fuel-air mixture.

12. Means as defined in claim 8 wherein the combined area of said apertures constitutes substantially 30–50% of the entire area of said baffle.

13. Means as defined in claim 12 wherein the area of said inlet of said premixing passage is less than the combined area of said apertures of said baffle.

14. Means as defined in claim 11 wherein the base of said frusto-conically shaped baffle is located at its downstream end relative to the flow in said combustion chamber and that the angle at said base and the axis of said engine is substantially 25 degrees.

15. An improved polution emission combustor assembly for a gas turbine engine including linear means closed at one end and opened at the other defining an annular combustion chamber having a combustion zone adjacent said closed end, wall means surrounding a portion of said liner means and defining therewith an annular shaped passageway extending axially with respect to the engine axis and terminating adjacent said combustion zone defining a substantially frusto-conically shaped opening, baffle means contoured to fit across said frusto-conically shaped opening for admitting fuel/air mixture through a plurality of apertures formed therein into said combustion zone with a radial component and each of said apertures sized to create localized eddies adjacent each of said apertures on said combustion zone side for sustaining combustion, fuel nozzle means disposed in said annular passageway downstream of the inlet opening thereof and upstream of said baffle means for premixing fuel with air supplied to said annular shaped passageway from the engine compressor, and combustion air and dilution air openings in said liner means downstrealm of said baffle means for admitting compressor air into said combustion chamber, said combustion air and dilution air openings sized with respect to said apertures to produce a pressure gradient in said combustion chamber to minimize the dwell time of said fuel/air mixture in said combustion chamber so that the products of combustion flow substantially axially therein through said opened end without producing large recirculation zones.

* * * * *